US005735053A

United States Patent [19]

McGunigal

[11] Patent Number: 5,735,053

[45] Date of Patent: Apr. 7, 1998

[54] BOW SIGHT ASSEMBLY

[76] Inventor: Donald E. McGunigal, 2711 Glenhaven La., Winston-Salem, N.C. 27106

[21] Appl. No.: 560,703

[22] Filed: Nov. 20, 1995

[51] Int. Cl.[6] ..... F41G 1/467

[52] U.S. Cl. ..... 33/265; 124/87

[58] Field of Search ..... 33/265, 241; 124/87

[56] References Cited

U.S. PATENT DOCUMENTS

| | | | |
|---|---|---|---|
| 2,893,124 | 7/1959 | Sundquist | 33/265 |
| 3,849,894 | 11/1974 | Brougham | 33/265 |
| 3,871,105 | 3/1975 | Brougham | 33/265 |
| 4,481,717 | 11/1984 | Kowalski | 124/87 |
| 4,669,196 | 6/1987 | Kersey | 33/265 |
| 5,072,716 | 12/1991 | Sappington | 33/265 |
| 5,384,966 | 1/1995 | Gibbs | 124/87 |

*Primary Examiner*—Thomas B. Will
*Attorney, Agent, or Firm*—Charles Y. Lackey

[57] ABSTRACT

A bow sight assembly for an archery bow having a hollow tubular housing within which is positioned a slidably movable piston connected to a rod contained partially within the housing and external thereof. An insert closes the open end of the tubular member and retains the rod in a preselected position within the housing. A housing support device is movably and releasably secured to the bow. The sight assembly includes first and second sight supports and a sight secured to the second sight support, the first sight support being secured to the piston, and the first and second sight supports being movably secured to each other to provide a lateral sight adjustment. An indicating scale is positioned on the external surface of the housing to provide vertical sight adjustment, and the second sight support holds a pointer for indicating a particular reading on the indicating scale.

2 Claims, 2 Drawing Sheets

BOW SIGHT ASSEMBLY

BACKGROUND OF THE INVENTION

1. Field of the Invention

The present invention relates to archery bow sights and more particularly to a bow sight assembly which can be adjusted by the bow user by displacing a single knob.

2. Description of the Prior Art

Archery has become a very popular and desirable pastime for a large number of participants both in the field of competitive activity and in other sports areas such as hunting and fishing.

Bows, arrows and related devices have been significantly enhanced over the past several years with high technology utilizing, for example, exotic spring tensioning, sighting, scoping and other sophisticated features. Sights and accessories include slotted slights, multipin slights, dovetail slights and many others. Devices of this nature are made by a number of companies such as Golden Eagle Archery, Timberline Archery Products and Fine-Line, Inc.

Most of the currently used bow sights utilize a plurality of pins that are positioned for certain yardages so that the bow user, when estimating the distance between his or her shooting position and the target, focuses on the pin designated to be the closest yardage to that estimated. If the estimate is slightly above or slightly below a given pin yardage indication, the user must adjust upwardly or downwardly to compensate for that overshoot or shortfall.

Other more refined sights will allow the user to make adjustments by sliding an indicator to a given target distance after loosening several set screws or linkages that will permit such slide action and then retightening these components. This can be a rather tedious adjustment and a rather distracting activity for the bowman to undertake, particularly while hunting or in the midst of active competition.

Other sights utilize pendulum or framing elements that require the user to apply a more elaborate estimation procedure without any certainty of accuracy.

All of these prior art devices constitute significant improvements in the field of archery from early days when every shot was a pure estimate by the user. There is now required, because of the precision sport that this has become, even more sophisticated sighting devices that minimize the tediousness involved in sight adjustment and offer more expediency and accuracy than heretofore available. It is to this current need that the present invention is directed.

OBJECTIVES AND SUMMARY OF THE INVENTION

The purpose of the present invention, which will be described subsequently in greater detail, is to provide a bow sight assembly for a bow which has all of the advantages of prior art devices and none of the disadvantages.

Another objective of the present invention is to provide a bow sight assembly of the type described which can be adjusted by a displacement knob actuated by the user without tedious loosening and tightening actions on various screws and linkages to accomplish the adjustment.

Yet still another objective of the present invention is to provide a bow sight assembly of the type described that utilizes a piston slidably moving within a housing to which is secured a sight support device carrying means having a sight element.

Yet still a further objective of the present invention is to provide a bow sight assembly of the type described which has a scale and indicator showing immediately the distances for which the bow is currently adjusted which enables the user to change the distance by displacing the piston.

Yet still another further objective of the present invention is to provide a bow sight assembly of the type described which is precision built and compactly designed to avoid loosening arising as the bow is actuated.

These objectives are accomplished by the provision of a housing formed from a hollow tubular member which is closed by an end insert that supports a rod within the housing which is connected to a piston designed to slidably move up and down within the housing as the rod is displaced by a knob secured to an end which extends outside the piston. Sight support means are secured to the piston and extend outwardly through a slot in the housing so that it can move with the piston as it is actuated by the movement of the rod and piston attached thereto. The sight support means carries sight means which includes first and second sight supports and a sighting element affixed to one of the supports. When the rod or knob is displaced and the piston is moved within the housing, the connected sight support means moves in a similar manner. Thus, the attached sighting element moves in the same manner and is selectively positioned at a desired location indicated by a movably adjustable calibrated scale and indicator affixed thereto.

Thus, there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways.

It is also to be Understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development.

It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages, and the specific results obtained by its use, reference should be made to the following detailed specification taken in conjunction with the accompanying drawings wherein like characters of reference designate like parts throughout the several views.

DETAILED DESCRIPTION OF THE PREFERRED EMBODIMENT

Figure 1:
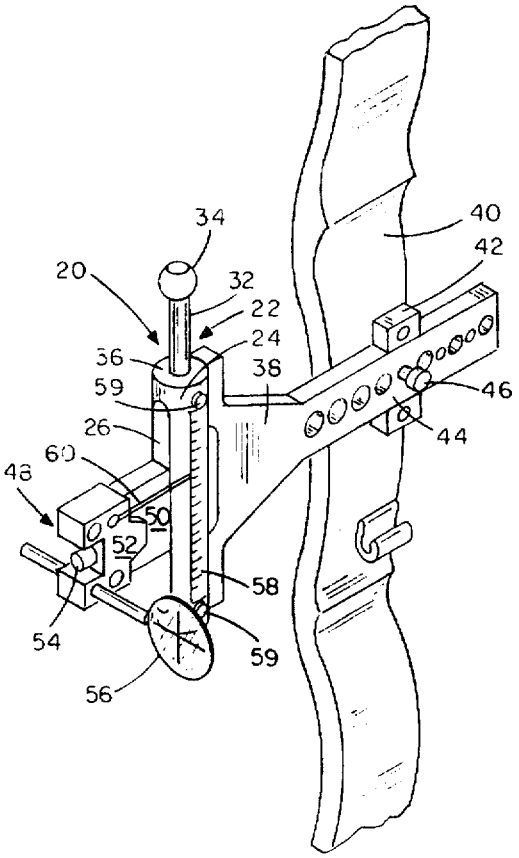
FIG. 1 is a perspective and fragmentary view of the bow sight assembly comprising the present invention which is attached to a bow.
Figure 2:
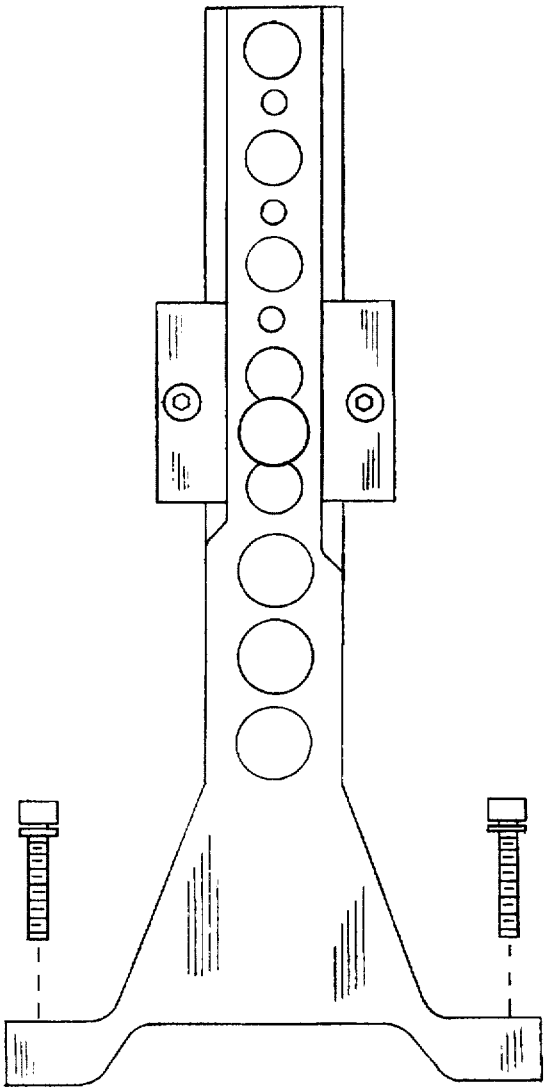
FIG. 2 is a side elevational and enlarged view of the housing support means isolated from the bow.
Figure 3:
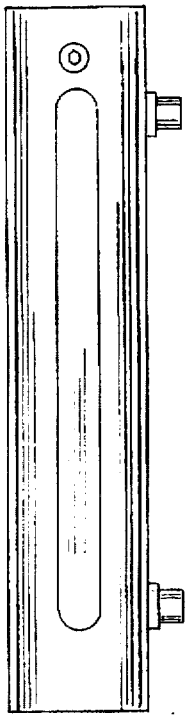
FIG. 3 is a side elevational and enlarged view of the housing isolated from the bow.
Figure 4:
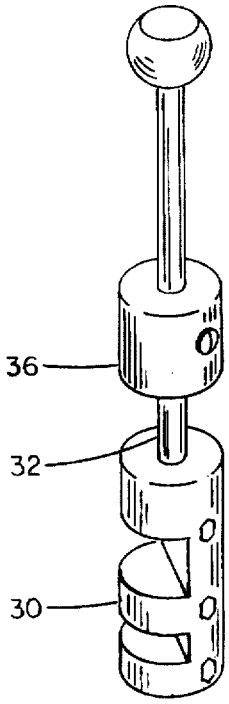
FIG. 4 is an enlarged and side elevational view of the piston, rod, insert guide and knob secured thereto isolated from the bow.
Figure 5:
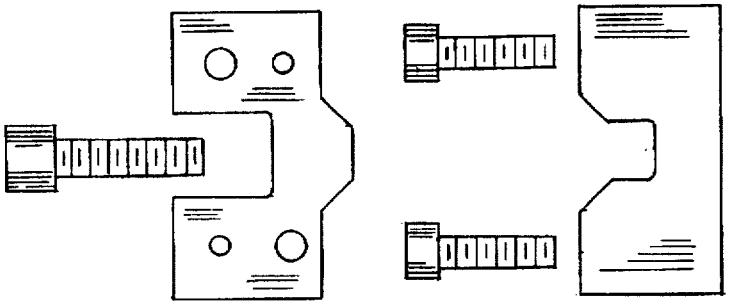
FIG. 5 is an exploded and enlarged view of the first and second sight supports isolated from the other components of the invention.
Figure 6:
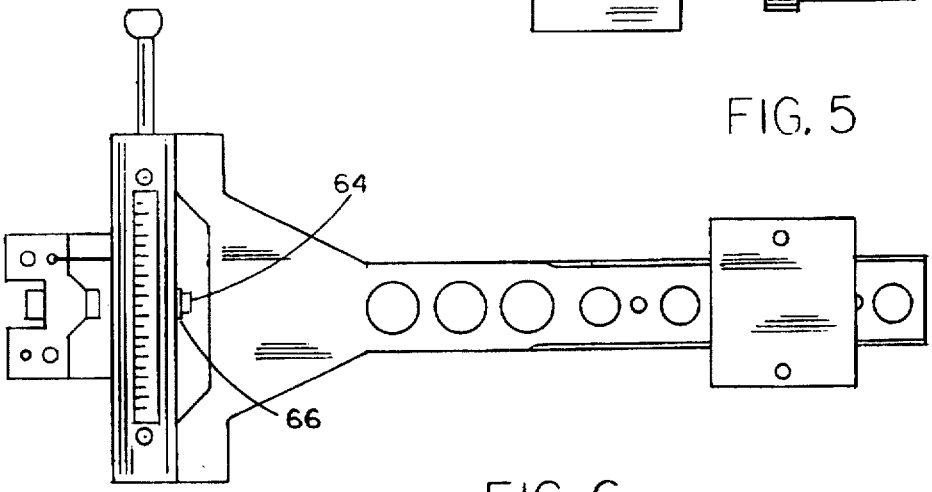
FIG. 6 is a side elevational view of the assembled housing support means, housing, rod and first and second sight supports isolated from the bow.

Referring now to the drawings and particularly to FIG. 1, the bow sight assembly shown generally as 20 includes a housing 22 formed from a hollow tubular member 24 with an interior 26 sufficient in diameter to encapsulate a piston 30 (FIG. 4) to which is secured a rod 32, a portion of which is in interior 26 and a portion of which extends outwardly therefrom. A knob 34 is secured to the external portion of rod 32 and serves as a handle for adjustment of the mechanism in a manner to be subsequently described. An insert guide 36 closes the upper end of tube 24 and retains rod 32 in a preselected slidable position within the housing.

A housing support member 38 is fixedly secured to housing 22 in the manner best shown in FIG. 1 and is releasably secured to the bow 40 by means of a base plate 42 cooperatively receiving the extending end 44 of member 38. An adjustment screw 46 secures extending end 44 in one of four different locations.

The sight holder assembly shown generally as 48 includes a first sight support 50 and a second sight support 52 which are movably secured to each other by an adjusting screw 54. Support 52 moves laterally with respect to support 50 when screw 54 is loosened to provide a lateral sight adjustment that accounts for windage and other external factors. A sight 56 is adjustably and releasably secured to second sight support 52 and is actually used by the archer to focus on the target.

A movably adjustable indicating scale 58 is fastened to the housing exterior as shown in FIG. 1. Indicating scale 58 is a distance scale and has markings representing different distances that will be known to the user. An indicator or pointer 60 is affixed to second sight support 52 and will visually point to the exact distance designated on scale 58. Thus, the user can visually read the pointer at the appropriate scale indicator to determine distance for which the sight is adjusted and make changes according to his needs by displacing knob 34 and rod 32 accordingly.

Indicating scale 58 is movably adjustable by loosening screws 59 so that the scale can be moved upwardly or downwardly as needed for a small distance since the hands of scale 58 are slotted openings. Some adjustment of the scale is helpful in that sight adjustments for specific distances must be made when conditions or equipment change; i.e., a heavier arrow is replaced by a lighter arrow which will travel in a higher trajectory for a longer distance. Being able to move scale 58 allows an adjustment to show the real distance on a scale when, for example, an arrow of different weight is used and a new distance must be factored into the sighting.

The bow assembly comprising the present invention can be made in different sizes to accommodate the preference of a particular user. The most common sizes likely to be desired are housing diameters of ½, ¾ and 1 inch. The ½ inch diameter is the lightest version and Would likely be used by women and children, which use lighter poundage bows.

To stabilize the sight assembly during actuation of the bow, a biasing screw 64 is inserted through the wall of cylinder 24 to engage piston 30 and frictionally prevent its displacement when the bow is actuated. A spring 66 normally holds screw 64 against the surface of cylinder 24, but that biasing action can be overridden when knob 34 and rod 32 are displaced by the user. The biasing screw 64 is used to regulate tension and friction on piston 30. Screw 64 and spring 66 can be adjusted to maintain the required friction on piston 30.

Sight support 52 has multiple holes tapped to accommodate various positions that might be needed for sight 56 and pointer 60.

The bow sight assembly comprising the present invention utilizes the various components as guides and stabilizing features. For example, the adjustment screw 64 functions as a guide as do piston 30 and rod 32. Also slot 26 functions as a guide so that all four of these components act cooperatively to stabilize the assembly.

With respect to the present invention, it is to be realized that the techniques involved in forming the novel combination set forth herein and the components associated therewith are unlimited. All equivalent relationships to those illustrated in the drawings and described in the specification are intended to be encompassed herein. The following is considered as illustrative only of the principles of the invention. Since numerous modifications and changes will readily occur to those skilled in the art, it is not desired to limit the invention to the exact construction and operation shown and described. All suitable modifications and equivalents that fall within the scope of the appended claims are deemed within the present inventive concept.

What is claimed is:

1. A bow sight assembly for a bow comprising: a housing including a hollow tubular member having first and second ends; a piston slidably moveable within and with respect to the housing; a rod connected to the piston and partially contained within the housing; means retaining the rod at a preselected slidable position within the housing; rod displacing means connected to the rod outside the housing; housing support means movably and releasably secured to the bow; means selectively engaging the piston to bias the piston in a non-movable position during actuation of the bow; means for selectively displacing the housing support means; sight means including first and second sight supports and a sight secured to the second sight support, the first sight support secured to the piston, and the first and second sight supports movably secured to each other to provide a lateral sight adjustment; and indicating means carried by the housing to provide vertical sight adjustments wherein the piston engaging means is a spring biased screw extending through the tubular member and against the piston.

2. A bow sight assembly for a bow comprising:

a housing including a hollow tubular member having first and second ends; a piston slidably moveable within and with respect to the housing; a rod connected to the piston and partially contained within the housing; means retaining the rod at a preselected slidable position within the housing; rod displacing means connected to the rod outside the housing; housing support means movably and releasably secured to the bow; means selectively engaging the piston to bias the piston in a non-movable position during actuation of the bow; means for selectively displacing the housing support means; sight means including first and second sight supports and a sight secured to the second sight support, the first sight support secured to the piston, and the first and second sight supports movably secured to each other to provide a lateral sight adjustment; and indicating means carried by the housing to provide vertical sight adjustments; and indicating means carried by the housing to provide vertical sight adjustments wherein the first sight support is a U-shaped member having an engaging slot therein and the second sight support is a U-shaped member having an extending engaging element cooperatively coupling with the engaging slot of the first sight support.

* * * * *